US008074986B1

(12) United States Patent
Gebhart

(10) Patent No.: US 8,074,986 B1
(45) Date of Patent: Dec. 13, 2011

(54) SET OF FIVE, FOURTEEN SIDED POKER DICE

(76) Inventor: Douglas A. Gebhart, Margate, FL (US)

( * ) Notice: Subject to any disclaimer, the term of this patent is extended or adjusted under 35 U.S.C. 154(b) by 0 days.

(21) Appl. No.: 12/242,127

(22) Filed: Sep. 30, 2008

Related U.S. Application Data

(63) Continuation-in-part of application No. 11/763,425, filed on Jun. 14, 2007, now abandoned.

(51) Int. Cl.
*A63F 9/04* (2006.01)

(52) U.S. Cl. ..... 273/146

(58) Field of Classification Search ..... None
See application file for complete search history.

(56) References Cited

U.S. PATENT DOCUMENTS

| | | | | | |
|---|---|---|---|---|---|
| 614,524 | A | * | 11/1898 | Yardley | 273/146 |
| 803,293 | A | * | 10/1905 | Friedenthal | 425/449 |
| 1,419,056 | A | * | 6/1922 | Kaufman | 273/146 |
| 1,481,628 | A | | 7/1922 | Souza | |
| 1,586,429 | A | * | 5/1926 | Kiesling | 273/272 |
| 2,024,541 | A | | 9/1932 | Silkman | |
| 2,922,652 | A | * | 1/1960 | Stange | 273/146 |
| 3,208,754 | A | * | 9/1965 | Sieve | 273/146 |
| 3,608,905 | A | * | 9/1971 | Edison | 273/146 |
| 3,913,919 | A | * | 10/1975 | Carpenter | 273/274 |
| 4,055,348 | A | * | 10/1977 | Marzoni, Jr. | 273/146 |
| 4,258,919 | A | * | 3/1981 | Martelli | 273/146 |
| 4,436,306 | A | * | 3/1984 | Sanders | 273/146 |
| 4,546,978 | A | * | 10/1985 | David | 273/146 |
| 4,989,875 | A | * | 2/1991 | Capy et al. | 273/146 |
| 5,125,660 | A | * | 6/1992 | Stahl | 273/146 |
| 5,145,175 | A | | 9/1992 | Gathman | |
| 5,224,708 | A | | 7/1993 | Gathman | |
| 5,342,059 | A | * | 8/1994 | Briem et al. | 273/277 |
| 5,556,096 | A | * | 9/1996 | Eardley et al. | 273/146 |
| 5,918,881 | A | * | 7/1999 | Kirby | 273/146 |
| 5,947,741 | A | * | 9/1999 | Villarreal | 434/171 |
| 6,428,005 | B2 | | 8/2002 | Au-Yeung | |
| 7,871,077 | B2 | | 1/2011 | Calvert | |

* cited by examiner

*Primary Examiner* — Alvin Hunter
*Assistant Examiner* — Dolores Collins

(57) ABSTRACT

A set of playing card indicia is applied to a set of five, fourteen sided dice. The dice can be provided in a variety of shapes, including a cuboctahedron, a truncated octahedron, a modified octahedron, a trapezoidal-based fourteen sided shape, and a spherical polyhedron. The indicia comprising a card value series defined as a series of nine numerical attributes two (2) thru ten (10) and four face value attributes Jack, Queen, King, and Ace. The indicia further comprising a suit series consisting of a club set, a heart set, a spades set, a diamond set and a fifth set of a different reference. Each disposed indicia comprising a unique combination of a value selected from the card value series and a suit series, such that no two indicia are replicated. The set of dice provides for games such as blackjack and poker. An optional wild value can be disposed upon the fourteenth side of the die.

8 Claims, 8 Drawing Sheets

SET OF FIVE, FOURTEEN SIDED POKER DICE

CROSS-REFERENCE TO RELATED APPLICATION

This Continuation-In-Part Utility application claims the benefit of co-pending United States Non-Provisional patent application Ser. No. 11/763,425, filed on Jun. 14, 2007, which is incorporated herein in its entirety.

BACKGROUND OF THE INVENTION

1. Field of the Invention

This invention discloses a new and improved set of five poker dice, and has for a set of objects the provisions for a die which in association with four others of similar style and method of surface marking can be used in many forms of dice, card, and casino games like Blackjack and Poker.

2. Description of the Prior Art

As known, Poker is a card game played with five cards from a standard deck of playing cards containing fifty-two numerical and face value attributes divided amongst four suits being: Diamonds (D), Spades (S), Hearts (H), and Clubs (C). Each suit having nine (9) numerical attributes two (2) thru ten (10), and four (4) face value attributes Jack (J), Queen (Q), King (K) and Ace (A) for a total of thirteen (13) attributes. By adding one wild card, commonly referred to as a Joker, or other attribute per suit a total of fourteen (14) attributes per suit is achieved.

Numerous attempts have been made at applying the playing card indicia on dice having 6, 8, 10, 12, 14, or 20 sides—for example, U.S. Pat. Nos. 244,520 (1881) Bacon, 1,481,628 (1924) Souza, 2,024,541 (1935) Silkman, 4,258,919 (1981) Martelli, 5,125,660 (1992) Stahl, and 6,428,005 (2002) by Au-Yeung are claiming the use of 6 sided die. Using five die with six sides, will only provide thirty sides for the possible fifty-two attributes, allowing for only a few possible poker hands as claimed.

U.S. Pat. No. D25,701 (1896) by Patten, claimed a single eight sided die design, and U.S. Pat. No. 4,989,875 (1991) Capy is for an eight sided die, played by varying the number of die used in a given game. The use of five-eight sided die can only provide forty sides for the fifty-two possible attributes as found in a deck of playing cards.

Several attempts have been made marking a single die or a set of die with ten (10) sides as outlined in U.S. Pat. Nos. 614,524 (1898) Yardley, 809,293 (1906) Friedenthal, and twelve (12) sided die as in 645,112 (1900) Mapes. The twelve (12) sided die patented by Edison U.S. Pat. No. 3,608,905 (1971), claims to use 10 and at most 11 of the possible thirteen attributes as used in a given suit, therefore allowing for only a few of the possible straight flush combinations.

In 1922 Kaufman patented a single fourteen (14) sided game die, U.S. Pat. No. 1,419,056, he claimed the use of numerical and letter attributes without suit on a single die. A player using five die of this design, would roll five of the same attribute, an example being five letter Q attributes of no suit, this design offers no possibility of rolling poker hands like a flush or straight flush.

The two patents by Gathman U.S. Pat. Nos. 5,145,175 (1992) and 5,224,708 (1993), claim using 3 or more identically marked 12 or 20 sided die, therefore a set of five 12 sided die would have sixty total sides and a set of five 20 sided die would have one hundred total sides, both totals being incompatible for an even distribution of the playing card indicia. Dice having identical surface markings on all die in a set of die, will roll five of the same attribute and suit, examples being—five kings of clubs or five jacks of spades, neither of which are poker hands.

A cuboctahedron is a polyhedron with eight triangular faces and six square faces. A cuboctahedron has twelve (12) identical vertices, with two triangles and two squares meeting at each, and twenty-four (24) identical edges, each separating a triangle from a square. As such it is a quasi-regular polyhedron, i.e. an Archimedean solid, being vertex-transitive and edge-transitive.

A dual polyhedron is the rhombic dodecahedron.

The truncated octahedron is an Archimedean solid. It has 8 regular hexagonal faces, 6 regular square faces, 24 vertices and 36 edges. Since each of its faces has point symmetry the truncated octahedron is a zonohedron.

A hexagon is a polygon with six edges and six vertices. A regular hexagon has Schlafli symbol.

The currently known prior art limits the use of dice in a card game by the number of sides and respective artwork disposed thereupon. Accordingly, there is a desire for a set of dice having a configuration conducive to a card game.

SUMMARY OF THE INVENTION

The present invention defines a set of five (5) dice, each die having a total of fourteen (14) planar, playing surfaces, each planar surface having a single identifying indicia. The group of dice provides a total of seventy (70) total playing surfaces. This provides a configuration capable of randomly selecting five (5) unique card values from a series of card value images having values between 2 and Ace as well as a Wild Card, each series having its own unique suit for a total of five (5) suits.

By marking a set of five, fourteen sided dice according to a predetermined suit combination as shown in Table 1 in conjunction with the method of marking each die in a progressively descending order as shown in Table 2, a player can roll all combinations of the five card Poker hand. And by rolling one die at a time, Blackjack can be played with the same set of dice.

A suit combination is one of one hundred twenty (120) possible five die combinations the suits can achieve. Table 1 illustrates an exemplary five sets of a minimum possible one-hundred twenty (120) sets that the suit attributes Diamonds (D), Spades (S), Hearts (H), and Clubs (C) and further introducing a fifth suit, presented as an exemplary embodiment of No suit (N) as used with the fifth set of attributes as shown in Table 1. The table presents an exemplary embodiment of the initial suit for each die, having an initial face being the Ace. For example, the table below presents Die 1 of set 1 having a first face being an Ace of Diamonds.

TABLE 1

| Set No. | Die 1 | Die 2 | Die 3 | Die 4 | Die 5 |
|---|---|---|---|---|---|
| Set 1 | Diamonds | Spades | Hearts | Clubs | No Suit |
| Set 2 | Clubs | Diamonds | Spades | Hearts | No Suit |
| Set 3 | Hearts | Clubs | Diamonds | Spades | No Suit |
| Set 4 | Spades | Hearts | Clubs | Diamonds | No Suit |
| Set 5 | No Suit | Spades | Hearts | Clubs | Diamonds |

The die may be constructed of any suitable material; the material that is preferred shall be of a character subject to fabricating and marking but being capable of maintaining its original configuration and appearance over time and extended usage. It is preferable that the die be fabricated of a material capable of having a relief formed thereon for receiving ink.

Each Indicia consists of a unique combination of a card value and suit selection. It is preferable that each die present one of each card value, plus an optional blank or wild card for a total of 14 indicia. Each die would have at least one of each of the suits distributed across the card values in a manner to not replicate two of the same card value/suit combinations.

Once the suit combination for a set of five die has been chosen, thirteen of the fourteen sides of each die will be marked with a card series, the card series comprising nine numerical attributes two (2) thru ten (10) and four (4) face value attributes J, Q, K, and A. In addition to the standard card values, the card series can preferably include a wild card being disposed upon the fourteenth side. The wild cards can include or be void of a suit reference.

Now that each of the five dies has been marked with the attributes, the suits can now be applied to the set of five die. For exemplary purposes the five die will be marked using the suit combination of D, S, H, C, and N in a descending repeating order and starting with the same value attribute on each die as shown in Table 2.

Table 2 presents an exemplary distribution of card values and card suits across a set of dice. Since the geometry of each planar surface may impact the probability of that side being rolled, the location of each value may be adjusted.

TABLE 2

| Side | Die 1 | Die 2 | Die 3 | Die 4 | Die 5 |
|---|---|---|---|---|---|
| Side 1 | AD | AS | AH | AC | AN |
| Side 2 | KN | KD | KS | KH | KC |
| Side 3 | QC | QN | QD | QS | QH |
| Side 4 | JH | JC | JN | JD | JS |
| Side 5 | 10S | 10H | 10C | 10N | 10D |
| Side 6 | 9D | 9S | 9H | 9C | 9N |
| Side 7 | 8N | 8D | 8S | 8H | 8C |
| Side 8 | 7C | 7N | 7D | 7S | 7H |
| Side 9 | 6H | 6C | 6N | 6D | 6S |
| Side 10 | 5S | 5H | 5C | 5N | 5D |
| Side 11 | 4D | 4S | 4H | 4C | 4N |
| Side 12 | 3N | 3D | 3S | 3H | 3C |
| Side 13 | 2C | 2N | 2D | 2S | 2H |
| Side 14 | WildH | WildC | WildN | WildD | WildS |

The set of dice provides a unique apparatus having the inventive ability to play a five suit card game, allowing a player to achieve five of a kind (same face value); one of each suit. The inclusion of a wild card enhances play. The wild card can be further defined by including a suit enhancing the game providing the ability to have fourteen potential sets of a single face value. The wild card additionally introduces a variety of optional plays utilizing or independent of the suit.

A dice set carrier can be included, the carrier being formed in the shape of the dice. The carrier would have an upper portion and a lower portion being hingably coupled there between. A dice holder can be disposed within the interior of the lower portion. The dice carrier having a set of die holding openings formed via a plurality of slits having a peripheral shape similar to and slightly smaller than a cross sectional area of the dice. A latch is incorporated on an edge of the carrier opposing the hinge. A representative artwork can be applied to the exterior of the carrier, the artwork being similar to the indicia's disposed upon the die.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION OF THE PREFERRED EMBODIMENTS

Figure 1A:
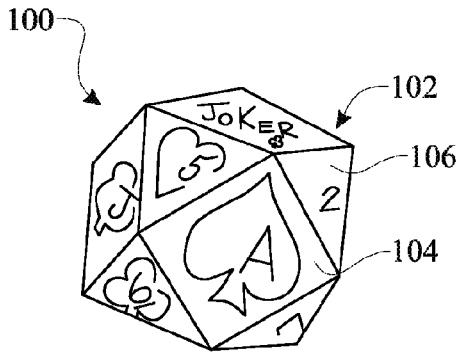
FIG. 1 is a perspective view of a set of five cuboctahedron shaped poker dice displaying the suit combination of D, S, H, C, and N.
Figure 1B:
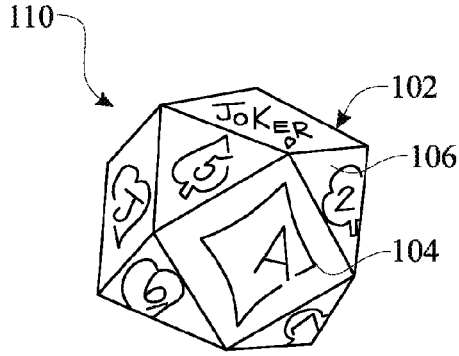
Figure 1C:
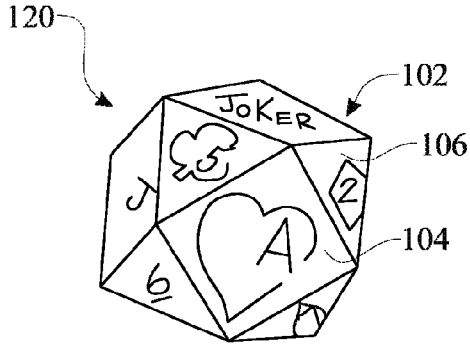
Figure 1D:
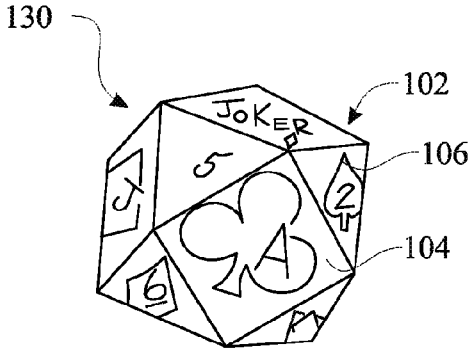
Figure 1E:
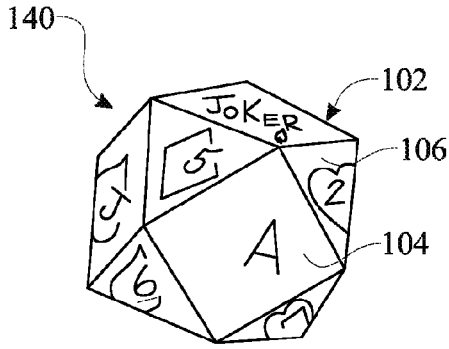
Figure 2:
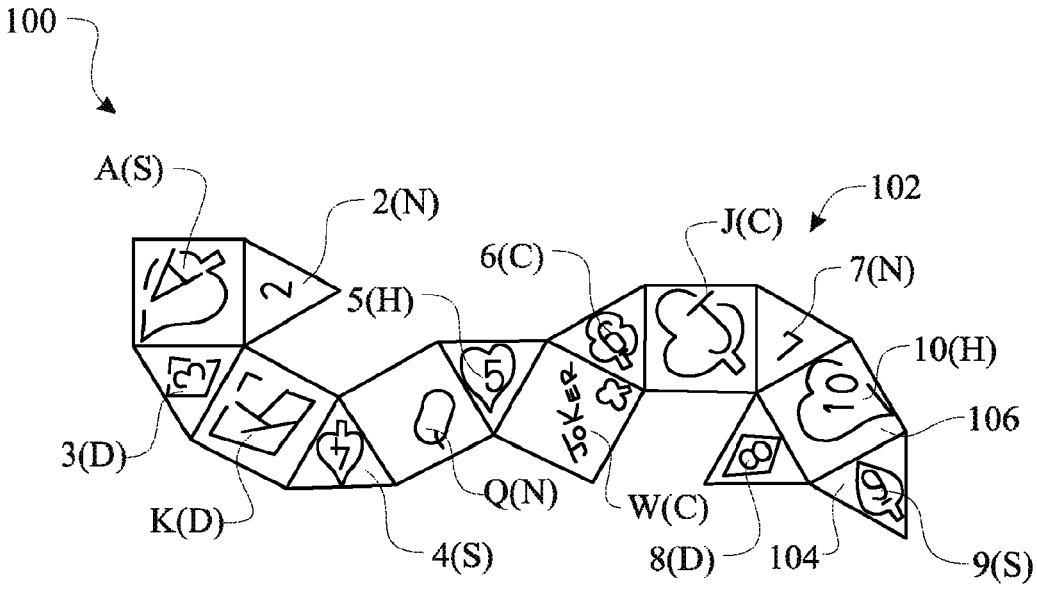
FIG. 2 is an exploded plan view illustrating all planar sides of a first exemplary die from the set of five cuboctahedron shaped poker dice originally presented in FIG. 1.
Figure 3:
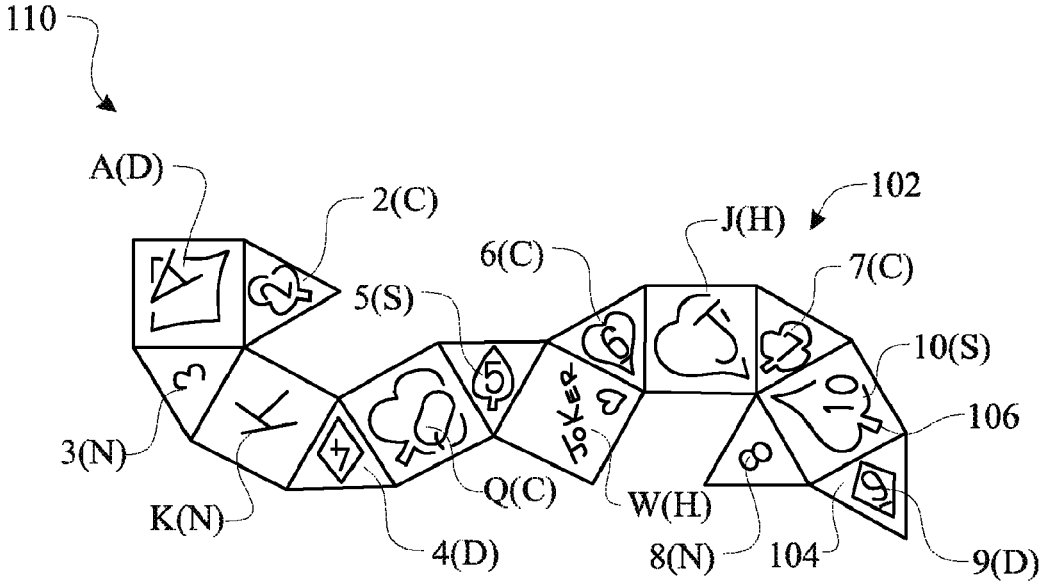
FIG. 3 is an exploded plan view illustrating all planar sides of a second exemplary die from the set of five cuboctahedron shaped poker dice originally presented in FIG. 1.
Figure 4:
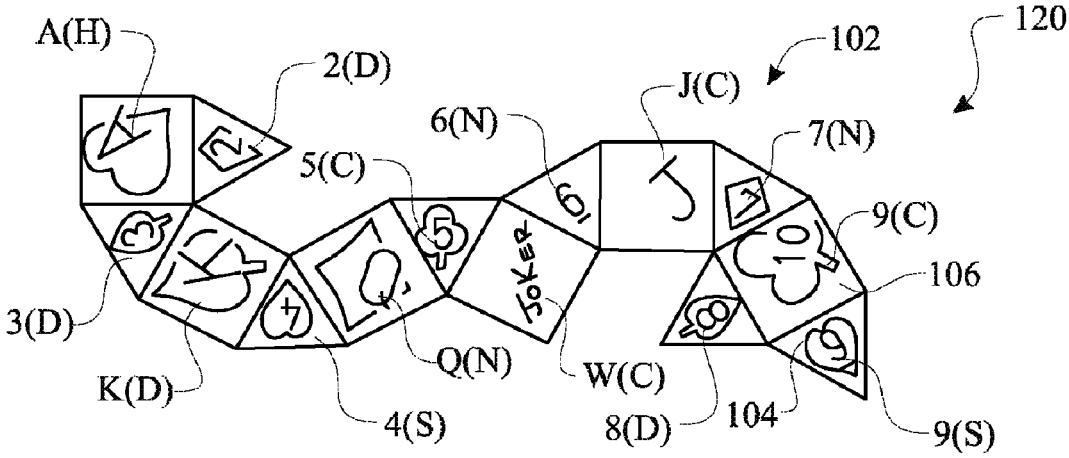
FIG. 4 is an exploded plan view illustrating all planar sides of a third exemplary die from the set of five cuboctahedron shaped poker dice originally presented in FIG. 1.
Figure 5:
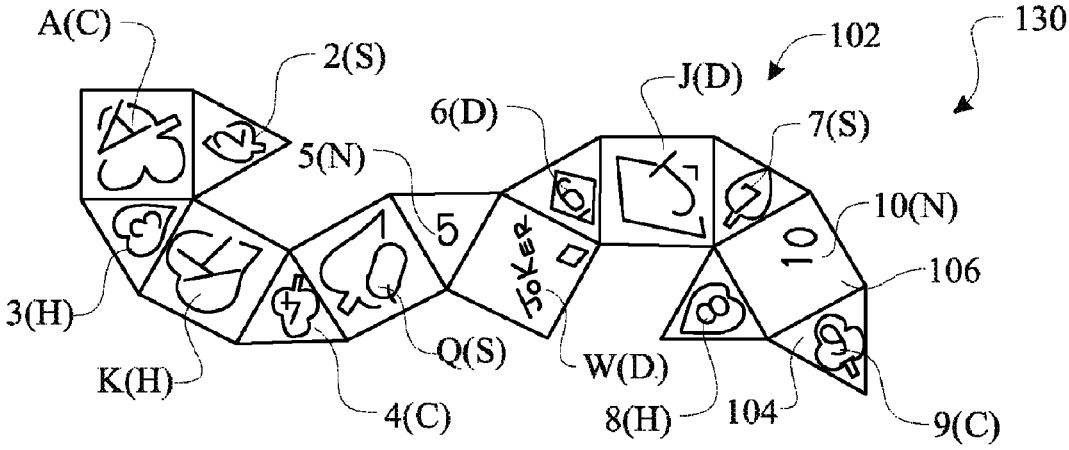
FIG. 5 is an exploded plan view illustrating all planar sides of a fourth exemplary die from the set of five cuboctahedron shaped poker dice originally presented in FIG. 1.
Figure 6:
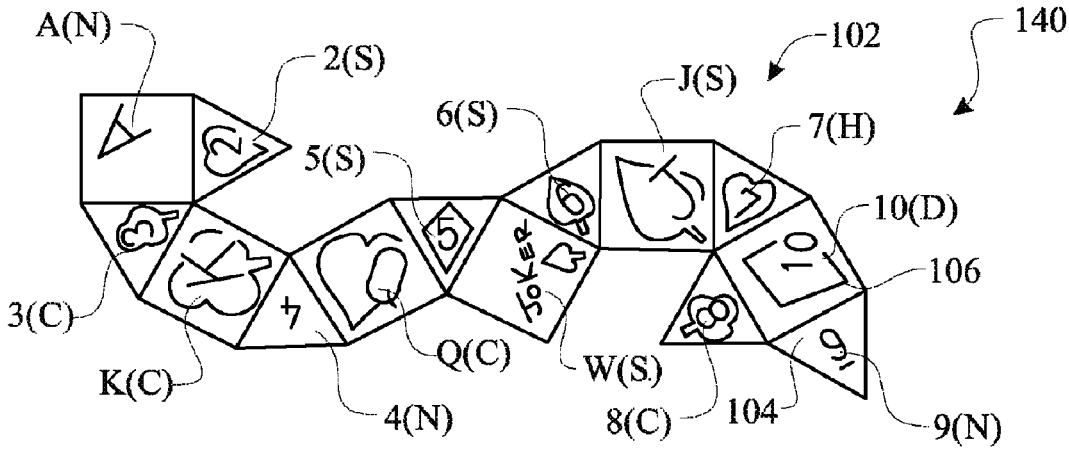
FIG. 6 is an exploded plan view illustrating all planar sides of a fifth exemplary die from the set of five cuboctahedron shaped poker dice originally presented in FIG. 1.

The present invention is directed at a set of five dice, each dice comprising fourteen planar sides. The dice includes indicia consisting of fourteen unique markings representative of a card value series. The card value series consisting of nine numerical attributes two (2) thru ten (10); four (4) face value attributes Jack (J), Queen (Q), King (K), and Ace (A); and, optionally, one (1) wild card. Each of the nine numerical attributes two (2) thru ten (10), and four (4) face value attributes J, Q, K, and A would include a respective suit. The suits would be distributed between each of the dice. This provides a total of 13 attributes for each suit. This also allows for a roll of five values of the same suit, commonly referred to as "five of a kind". The wild attributes could either include or exclude suit markings.

A representative fourteen sided dice 100 in the form factor of a cuboctahedron is presented in various forms being detailed in FIGS. 1 through 6. The exemplary embodiment, referred to as a representative fourteen sided dice 100, is formed having a die body 102 defined by a total of six four sided planar surfaces 104 and eight three sided planar surfaces 106. The set of dice consists of five die, each identified as representative fourteen sided dice 100, second representative fourteen sided dice 110, third representative fourteen sided dice 120, fourth representative fourteen sided dice 130, and fifth representative fourteen sided dice 140 and having its own unique series of indicia; having all numerical, face value and suit attributes contained in a standard deck of playing cards have been evenly disbursed among the five die without replicating or deleting any attributes. It is preferable to apply the higher card values (face cards) and wild card values onto the four sided planar surfaces 104, as the four sided planar surfaces 104 has a larger surface area and is more likely to land face up. It is also preferable to apply the same value on the same die surface shape amongst each of the die to maintain consistency across the set of dice. The planar surfaces of the die are presented as a flat view in FIGS. 2 through 6. It is understood the layout can vary from the exemplary embodiments presented, with the exemplary indicia presented in table 3.

TABLE 3

| | | Die No./Suit | | | | |
|---|---|---|---|---|---|---|
| Side | Value | 1 | 2 | 3 | 4 | 5 |
| 1 | Ace | Spade (S) | Diamond (D) | Heart (H) | Clubs (C) | None (N) |
| 2 | 2 | None | Clubs | Diamond | Spade | Heart |
| 3 | 3 | Diamond | None | Spade | Heart | Clubs |
| 4 | King (K) | Diamond | None | Spade | Heart | Clubs |
| 5 | 4 | Spade | Diamond | Heart | Clubs | None |
| 6 | Queen (Q) | Clubs | None | Diamond | Spade | Heart |
| 7 | 5 | Heart | Spade | Clubs | None | Diamond |
| 8 | Wild (Joker) | Clubs | Heart | None | Diamond | Spade |
| 9 | 6 | Clubs | Heart | None | Diamond | Spade |
| 10 | Jack (J) | Clubs | Heart | None | Diamond | Spade |
| 11 | 7 | None | Clubs | Diamond | Spade | Heart |
| 12 | 10 | Heart | Spade | Clubs | None | Diamond |
| 13 | 9 | Spade | Diamond | Heart | Clubs | None |
| 14 | 8 | Diamond | None | Spade | Heart | Clubs |

Each of the individual planar surfaces is defined by a unique combination of a face value and a suit in the figures. The specific planar surface can have either or both the face values and respective suit changed to alter the odds of the potential roll.

Figure 7:
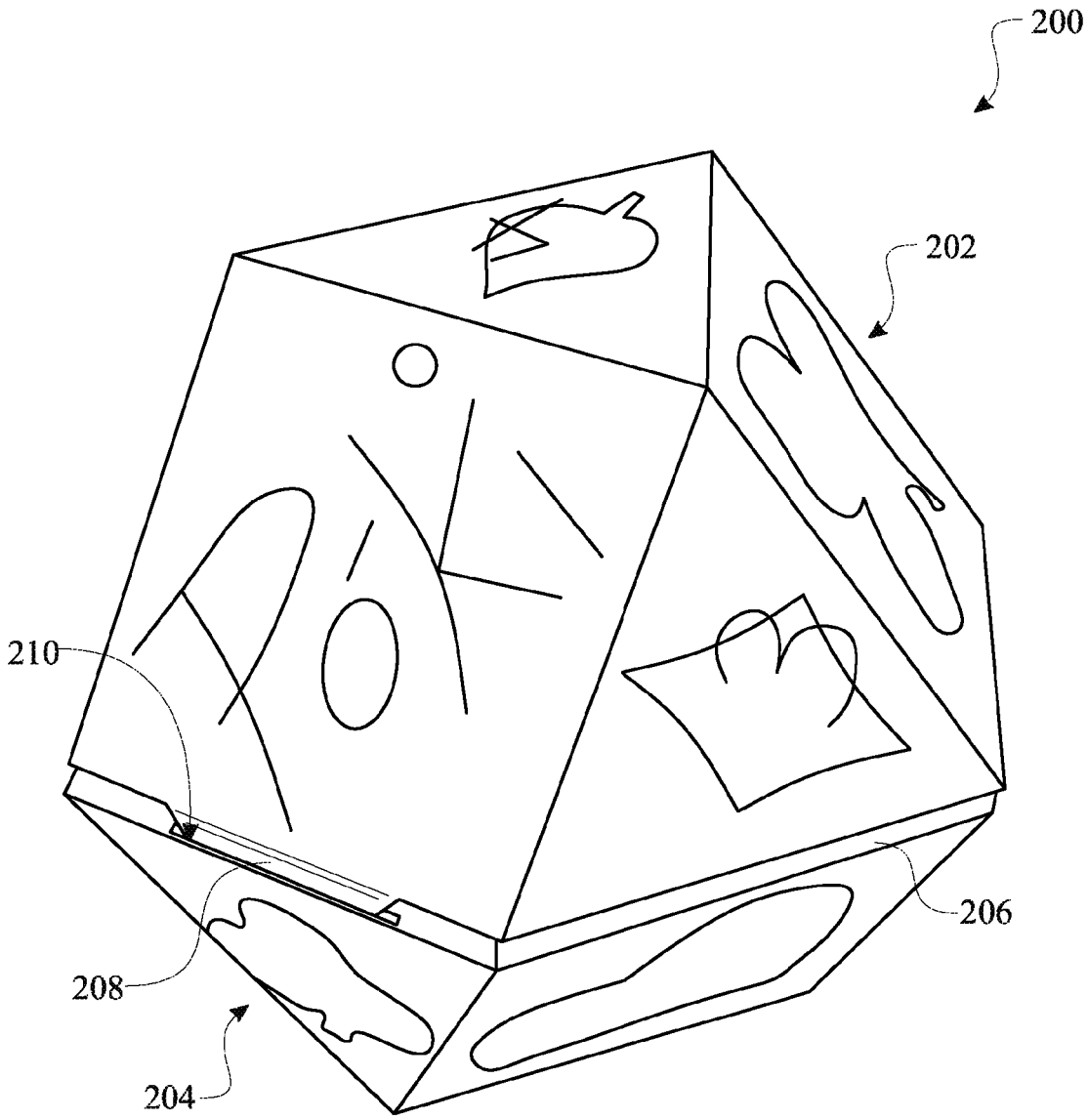
FIG. 7 is an isometric view of an exemplary dice carrier in a closed configuration.
Figure 8:
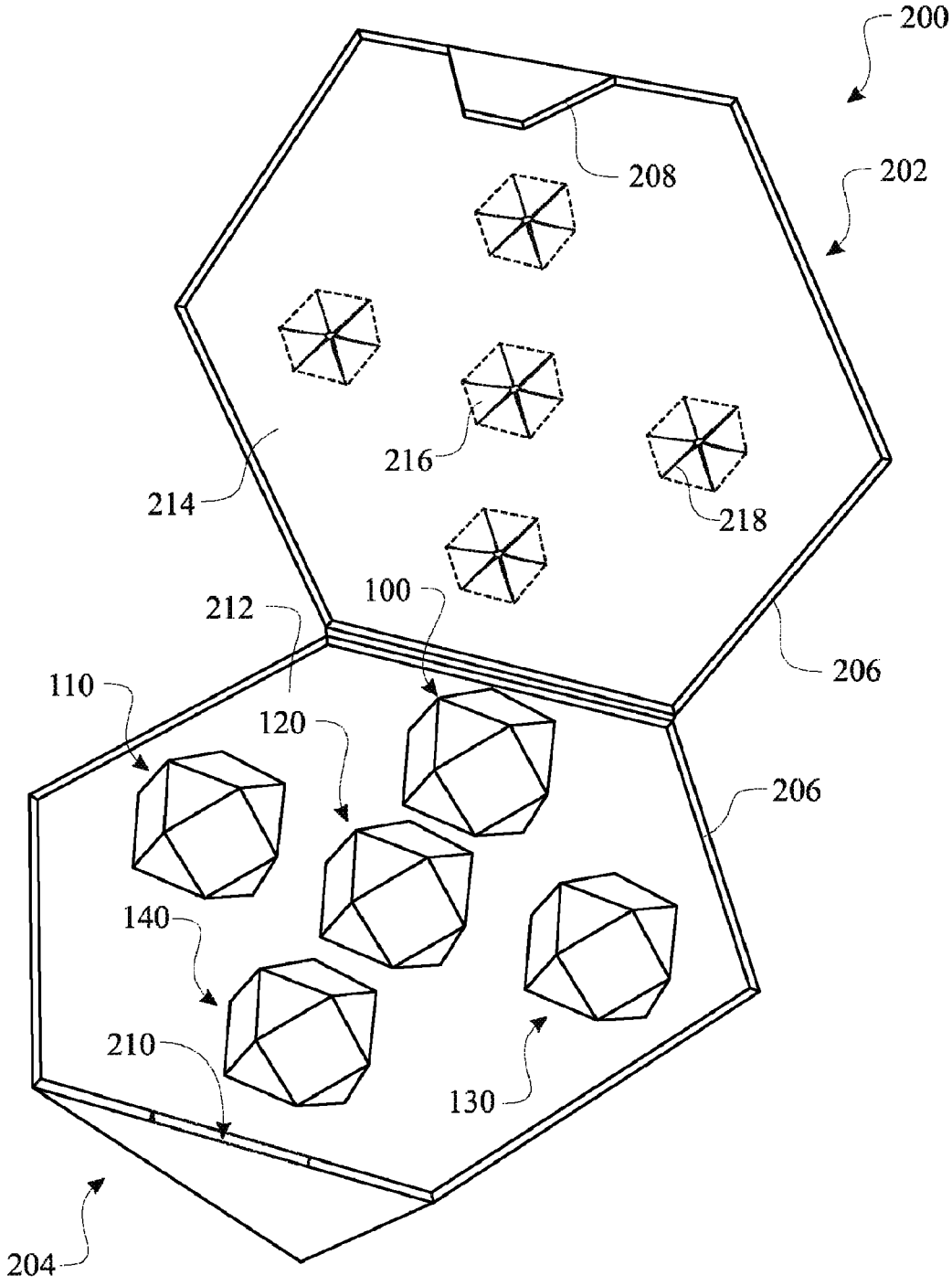
FIG. 8 is an isometric view of the exemplary dice carrier in an opened configuration.

The Dice are provided in a set, which can be carried in a dice carrier 200 as illustrated in FIGS. 7 and 8. The dice carrier 200 is divided into an upper carrier portion 202 and a lower carrier portion 204, which are hingeably coupled to each other via a hinge located along the mating interface 206 opposing a closure tab 208. The closure tab 208 can be incorporated into either the upper carrier portion 202 or the lower carrier portion 204, with a closure aperture 210 being incorporated into the opposing portion. A set of dice 100, 110, 120, 130, 140 are each placed into a respective aperture (similar to die apertures 216 provided in a securing storage surface 214). Each die aperture 216 is formed via a plurality of slits 218 forming an opening within the respective storage surface 212, 214. The opening would be slightly smaller than the maximum circumference of the die 100. The user would place the set of dice 100 into the openings in the storage surface 212, rotate the upper carrier portion 202 into a closed configuration placing the exposed portion of the dice 100 into the die aperture 216 of the securing storage surface 214, and inserting the closure tab 208 into the closure aperture 210. This provides a safe and secure carrier for the dice 100.

Figure 9:
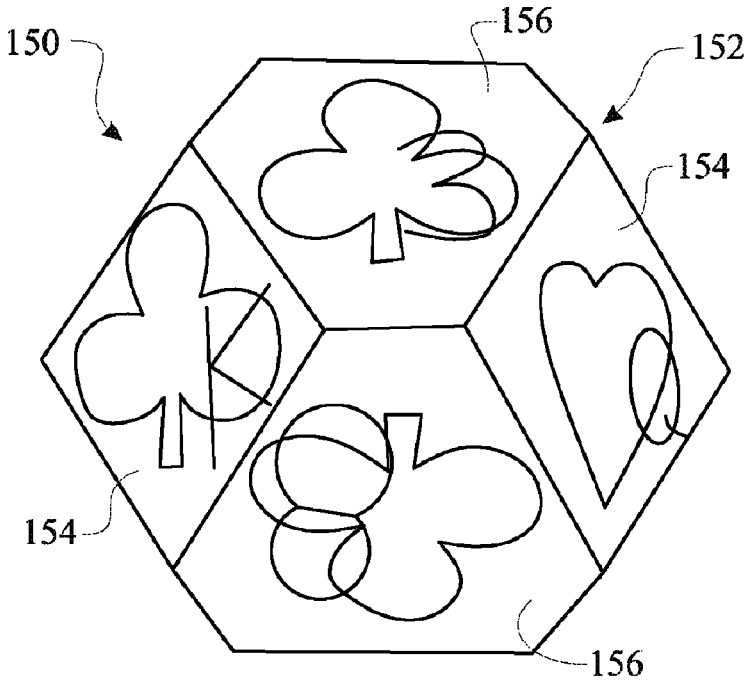
FIG. 9 is an isometric view of an alternate exemplary embodiment of the fourteen sided die, more specifically, a truncated octahedron shaped poker dice.

It is understood that although the initial teachings present a cuboctahedron shaped poker dice as an initial embodiment, other fourteen-sided shapes can be utilized. A truncated octahedron shaped poker dice 150 is representative of another die embodiment illustrated in FIG. 9. The truncated octahedron shaped poker dice 150 is fabricated having a die body 152 which is formed consisting of six four-sided planar surfaces 154 and eight six-sided planar surfaces 156 as illustrated. The indicia would be disposed upon each of the fourteen total planar surfaces.

Figure 10:
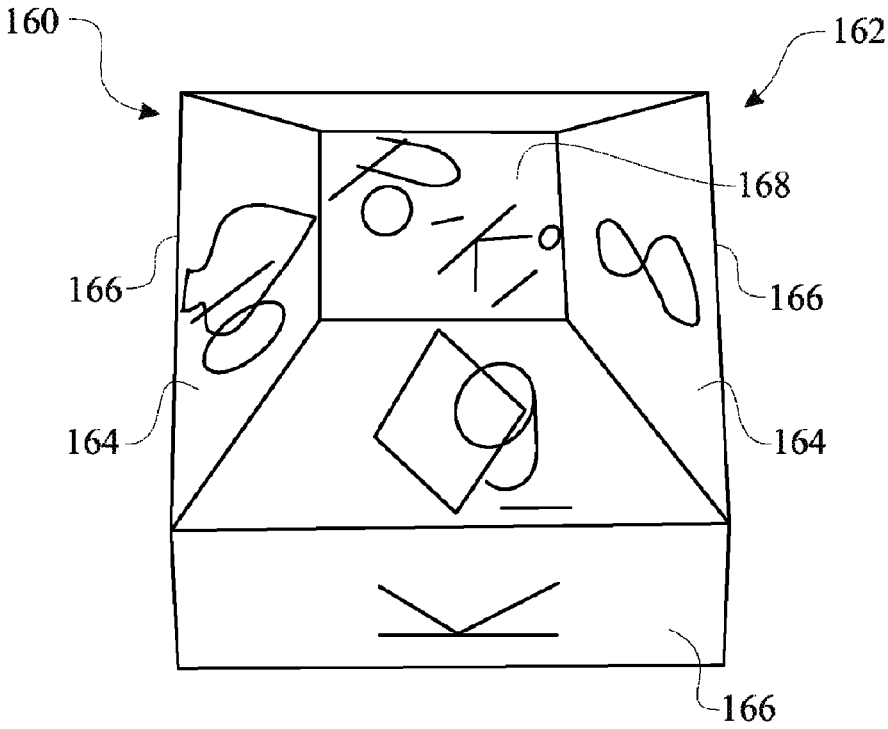
FIG. 10 is an isometric view of another exemplary embodiment of the fourteen sided die, more specifically, an octahedron, truncate each of a top and bottom corner and along the midline edge.

A modified octahedron shaped poker dice 160 is representative of another die embodiment illustrated in FIG. 10. The modified octahedron shaped poker dice 160 is fabricated having a die body 162 which is formed consisting of eight trapezoidal planar surfaces 164; four, four-sided waistline surfaces 166; and two, four-sided end surfaces 168 as illustrated. The shape comprising a square surface at each of a top and bottom portion (end surfaces 168), four rectangular shaped surfaces (four sided waistline surfaces 166) located substantially perpendicular to the four sided end surfaces 168 along a midline of the die, and a total of eight trapezoidal planar surfaces 164 with four disposed between the four-sided waistline surfaces 166 and the top surface (four-sided end surfaces 168 as shown) and four disposed between the rectangular midline surfaces and the bottom surface (side which opposes the four-sided end surfaces 168 shown). The indicia would be disposed upon each of the fourteen total planar surfaces.

Figure 11:
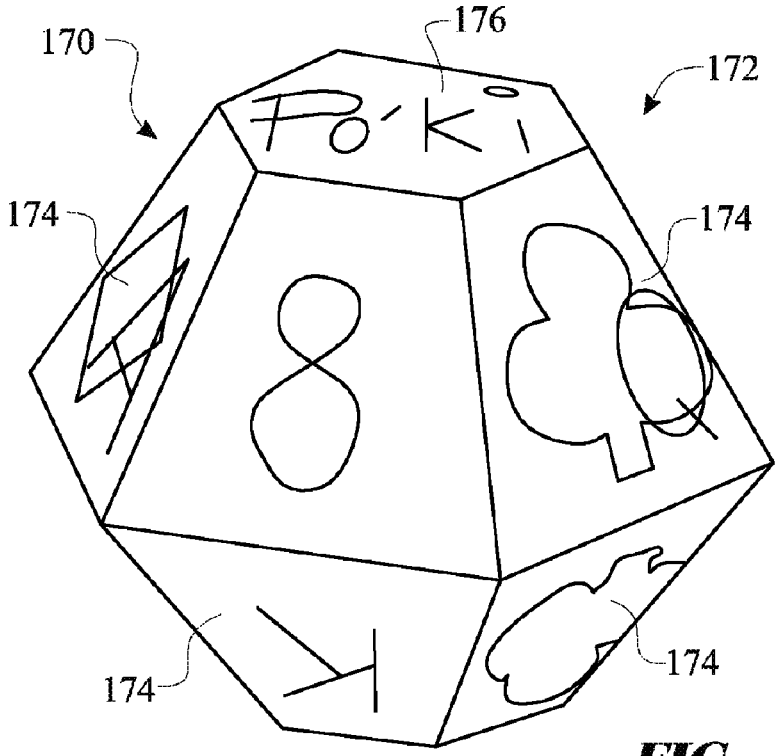
FIG. 11 is an isometric view of yet another exemplary embodiment of the fourteen sided die, more specifically, a Hexagonal Bifrustum die defined having two regular hexagon shapes disposed on each opposing end and six trapezoidal shaped surfaces located between each regular hexagon and the midline.

A trapezoidal based, fourteen sided die 170 (having a shape referred to as hexagonal bifrustum) is representative of yet another die embodiment illustrated in FIG. 11. The trapezoidal based fourteen sided die 170 is fabricated having a die body 172 which is formed consisting of twelve trapezoidal shaped sides 174 and two hexagon shaped sides 176 as illustrated. The shape comprising a hexagon surface at each of a top and bottom portion (hexagon shaped sides 176) and twelve trapezoidal shaped sides 174 disposed between the top and bottom surfaces (hexagon shaped sides 176). The trapezoidal shaped sides 174 are distributed having six located above the waistline and six located below the waistline of the die as illustrated. The trapezoidal shape of each trapezoidal shaped side 174 includes two base edges, one being smaller than the other. The smaller base edge abuts with an edge of the respective hexagon shaped side 176. The larger edge abuts with a similar edge of an adjacent trapezoidal shaped side 174. Each of the legs of the trapezoidal shaped side 174 abuts with the adjacent leg of the adjacent trapezoidal shaped side 174. The indicia would be disposed upon each of the fourteen total planar surfaces.

Figure 12:
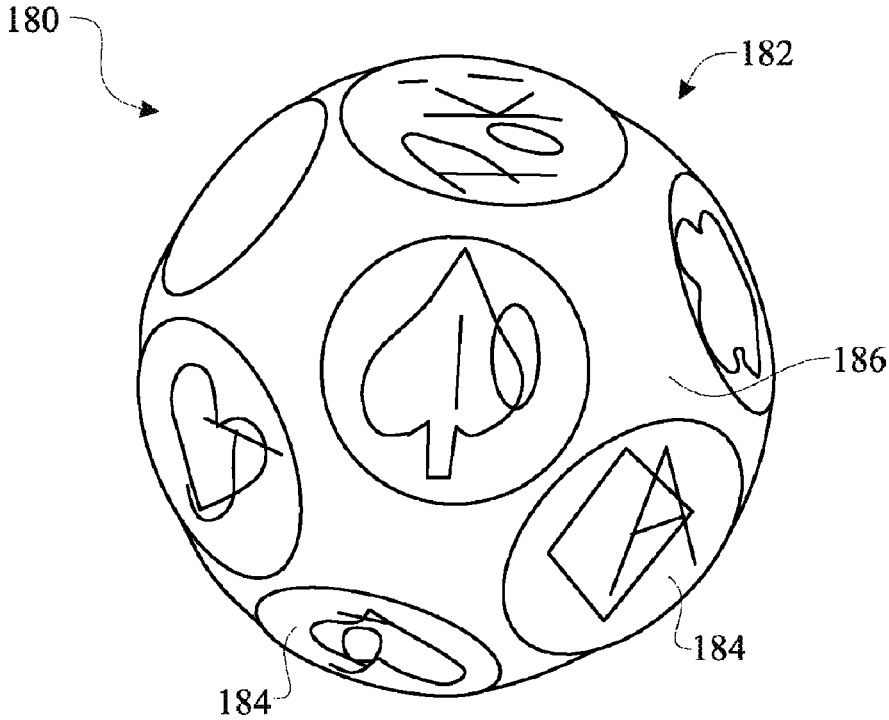
FIG. 12 is an isometric view of yet another exemplary embodiment of the fourteen sided die, more specifically, a die having a spherical main body and fourteen planar surfaces disposed evenly about the spherical main body.

A spherical polyhedron die 180 is representative of yet another die embodiment illustrated in FIG. 12. The spherical polyhedron die 180 is fabricated having a die body 182 which is formed in the general shape of a circular planar surface 186 with a total of fourteen spherical surface 184 located in opposing configurations, as illustrated. The indicia would be disposed upon each of the fourteen total planar surfaces.

Figure 13:
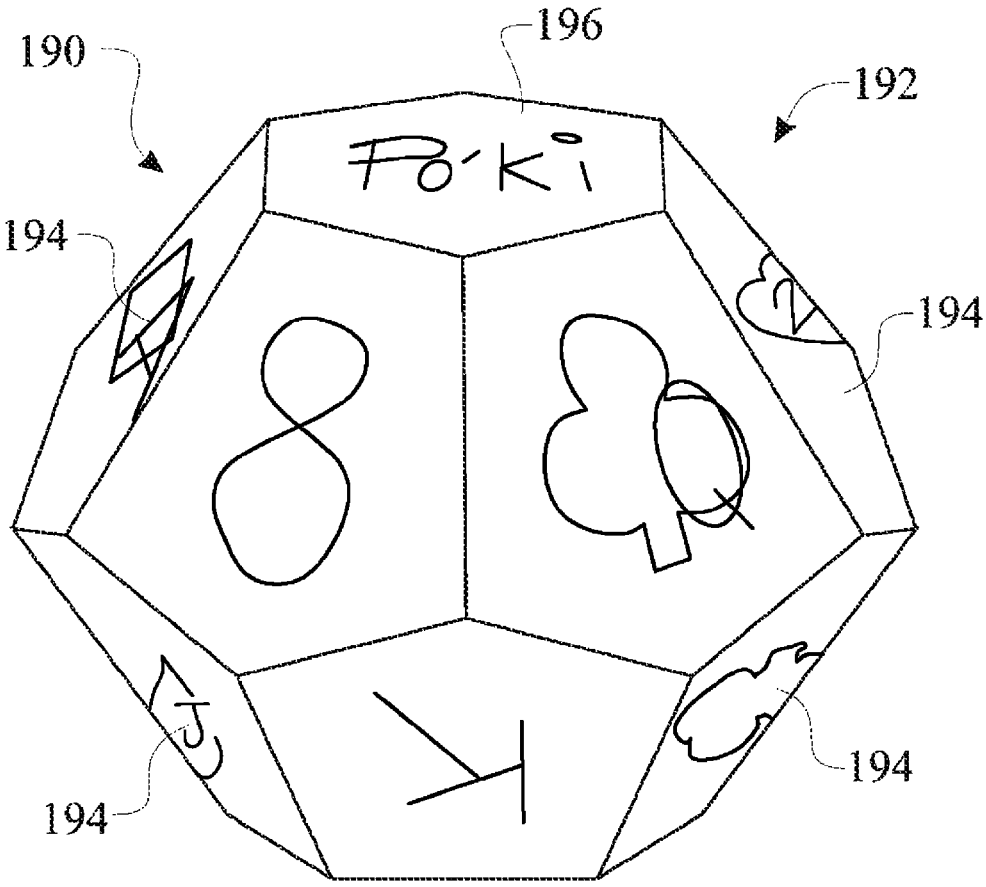
FIG. 13 is an isometric view of yet another exemplary embodiment of the fourteen sided die, more specifically, a Hexangonal Truncated Trapezohedron shaped die defined having two regular hexagon shapes disposed on each opposing end and twelve irregular pentagon shaped surfaces located between each regular hexagon.

A hexangonal truncated trapezohedron shaped die 190 is representative of yet another die embodiment illustrated in FIG. 13. The hexangonal truncated trapezohedron shaped die 190 is fabricated having a die body 192 which is formed consisting of twelve pentagon shaped sides 194 and two hexagon shaped sides 196 as illustrated. The shape comprising a hexagon surface at each of a top and bottom portion (hexagon shaped sides 196) and twelve pentagon shaped sides 194 disposed between the top and bottom surfaces (hexagon shaped side 196). The pentagon shaped sides 194 are distributed having six located above a jagged waistline and six located below the jagged waistline of the die as illustrated. A distal edge of each of the pentagon shaped side 194 intersects with an edge of either the upper or lower hexagon shaped side 196. The remaining edges abut with an adjacent pentagon shaped side 194. The indicia would be disposed upon each of the fourteen total planar surfaces.

Since many modifications, variations, and changes in detail can be made to the described embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A set of fourteen sided dice, comprising:

a set of five dice, each die comprising a die body defined by fourteen planar surfaces separated from one another by linear edges, each planar surface bounded by at least three linear edges, each linear edge joining a pair of adjacent planar surfaces;

an indicia disposed upon each of thirteen of the fourteen planar surfaces, each die has at least one of each of five suits incorporated thereon; wherein the five suits are a club set, a heart set, a spades set, a diamond set and a fifth set of a different reference;

wherein the die are formed in a shape of at least one of:

a) a cuboctahedron, b) a truncated octahedron, c) a modified octahedron, d) a trapezoidal based fourteen sided geometry, and e) a hexagonal truncated trapezohedron, and f) a spherical polyhedron;

each die further comprising a wild value disposed upon the fourteenth planar surface; wherein each wild value further comprising a unique suit selected from a suit series, the suit series consisting of a club set, a heart set, a spades set, a diamond set and a fifth set of a different reference;

wherein at least one die is formed in a modified octahedron shape comprising:

a rectangular shaped top surface, a rectangular shaped bottom surface, four rectangular shaped waistline surfaces, each adjoining to an adjacent rectangular shaped waistline surface along an abutting vertical edge forming a rectangular shape;

eight trapezoidal shaped planar surfaces having a midline base edge and a distal edge, wherein the midline base edge is longer than distal edge;

wherein four trapezoidal shaped planar surfaces are positioned with the midline base edge abutting an upper edge of the rectangular waistline surface and the distal edge abutting an edge of the rectangular shaped top surface; and wherein four trapezoidal shaped planar surfaces are positioned with the midline base edge abutting a lower edge of the rectangular waistline surface and the distal edge abutting an edge of the rectangular shaped lower surface;

a fourteenth planar surface comprising an indicia selected from a fourteenth indicia group comprising a blank face and a wild value;

a card value series defined as a series of nine numerical attributes two (2) thru ten (10) and four face value attributes Jack, Queen, King, and Ace;

a suit series, the suit series comprising five unique suits;

five card value series, each a card value of the card value series associated with its own unique suit selected from the suit series;

each disposed indicia comprising a unique combination of a value selected from the card value series and a suit series, such that no two indicia are the replicated, wherein the indicia is applied in accordance with the following:

| Side | Card Value | Die 1 | Die 2 | Die 3 | Die 4 | Die 5 |
|---|---|---|---|---|---|---|
| 1 | 2 | 5th Suit | 1st Suit | 4th Suit | 3rd Suit | 2nd Suit |
| 2 | 3 | 4th Suit | 5th Suit | 3rd Suit | 2nd Suit | 1st Suit |
| 3 | 4 | 3rd Suit | 4th Suit | 2nd Suit | 1st Suit | 5th Suit |
| 4 | 5 | 2nd Suit | 3rd Suit | 1st Suit | 5th Suit | 4th Suit |
| 5 | 6 | 1st Suit | 2nd Suit | 5th Suit | 4th Suit | 3rd Suit |
| 6 | 7 | 5th Suit | 1st Suit | 4th Suit | 3rd Suit | 2nd Suit |
| 7 | 8 | 4th Suit | 5th Suit | 3rd Suit | 2nd Suit | 1st Suit |
| 8 | 9 | 3rd Suit | 4th Suit | 2nd Suit | 1st Suit | 5th Suit |
| 9 | 10 | 2nd Suit | 3rd Suit | 1st Suit | 5th Suit | 4th Suit |
| 10 | Jack (J) | 1st Suit | 2nd Suit | 5th Suit | 4th Suit | 3rd Suit |
| 11 | Queen (Q) | 1st Suit | 5th Suit | 4th Suit | 3rd Suit | 2nd Suit |
| 12 | King (K) | 4th Suit | 5th Suit | 3rd Suit | 2nd Suit | 1st Suit |
| 13 | Ace | 3rd Suit | 4th Suit | 2nd Suit | 1st Suit | 5th Suit. |

where each of the first, second, third, fourth, and fifth suits are different and wherein a roll of the set of fourteen sided dice creates a five card hand, the dice being analogous to a complete deck of cards expanded from four unique suits to five unique suits.

2. A set of fourteen sided dice as recited in claim 1, wherein at least one die is formed in a cuboctahedron shape defined by six square planar surfaces and eight triangular planar surfaces.

3. A set of fourteen sided dice as recited in claim 1, wherein at least one die is formed in a truncated octahedron shape defined having six square planar surface and eight hexagonally shaped planar surfaces, wherein each of edge of each square surface abut an edge of the hexagonally shaped surface.

4. A set of fourteen sided dice as recited in claim 1, wherein at least one die is formed in a trapezoidal based fourteen sided shape comprising:

a hexagon shaped top surface, a hexagon shaped bottom surface, six upper trapezoidal shaped planar surfaces having a midline base edge and a distal edge, wherein the midline base edge is longer than distal edge;

six lower trapezoidal shaped planar surfaces having a midline base edge and a distal edge, wherein the midline base edge is longer than distal edge;

wherein each six upper trapezoidal shaped planar surface is positioned with the midline base edge abutting the midline base edge of the adjacent lower trapezoidal shaped planar surface, the distal edge abutting an edge of the hexagon shaped top surface, and each leg of the upper trapezoidal shaped planar surface abuts an adjacent leg of the adjacent upper trapezoidal shaped planar surface; and wherein each six lower trapezoidal shaped planar surface is positioned with the midline base edge abutting the midline base edge of the adjacent upper trapezoidal shaped planar surface, the distal edge abutting an edge of the hexagon shaped bottom surface, and each leg of the lower trapezoidal shaped planar surface abuts an adjacent leg of the adjacent lower trapezoidal shaped planar surface.

5. A set of fourteen sided dice as recited in claim 1, wherein at least one die is formed in a hexangonal truncated trapezohedron shape comprising a pair of hexagonally shaped ends having twelve pentagon shaped planar surfaces disposed there between.

6. A set of fourteen sided dice as recited in claim 1, wherein all five dice have the same geometry.

7. A set of fourteen sided dice as recited in claim 1, the carrier further comprising:

an upper portion;

a lower portion;

the upper portion and lower portion adjustably attached to each other providing access to an interior of the carrier; and wherein the storage surface is disposed within at least one of the upper portion and the lower portion.

8. A set of fourteen sided dice as recited in claim 1, the carrier is formed having the unique same shape of the die being carried inside.

* * * * *